US007658684B2

(12) United States Patent
Ferris

(10) Patent No.: US 7,658,684 B2
(45) Date of Patent: Feb. 9, 2010

(54) GOLF CLUB GRIP

(76) Inventor: Richard D. Ferris, 3521 Glenbrook Rd., Fairfax, VA (US) 22031

( * ) Notice: Subject to any disclaimer, the term of this patent is extended or adjusted under 35 U.S.C. 154(b) by 0 days.

(21) Appl. No.: 12/155,169

(22) Filed: May 30, 2008

(65) Prior Publication Data

US 2008/0242440 A1 Oct. 2, 2008

Related U.S. Application Data

(63) Continuation-in-part of application No. PCT/US06/45694, filed on Nov. 30, 2006, and a continuation-in-part of application No. 11/289,564, filed on Nov. 30, 2005.

(51) Int. Cl.
*A63B 53/14* (2006.01)

(52) U.S. Cl. ..... 473/300

(58) Field of Classification Search ..... 473/300–303, 473/549–552, 568, 294; 74/551.9; D8/DIG. 7, D8/DIG. 8, DIG. 6; 81/489; 16/DIG. 18, 16/DIG. 19, DIG. 12, 421, 430
See application file for complete search history.

(56) References Cited

U.S. PATENT DOCUMENTS

| | | | | |
|---|---|---|---|---|
| 3,173,689 | A | 3/1965 | Serblin | |
| 3,295,850 | A | 1/1967 | Garrity | |
| 4,163,554 | A * | 8/1979 | Bernhardt | 473/255 |
| 4,438,925 | A | 3/1984 | Lindstrom | |
| 5,415,399 | A * | 5/1995 | Kettelson | 473/239 |
| 6,068,562 | A * | 5/2000 | Hedges | 473/409 |
| 6,663,499 | B2 * | 12/2003 | Riseley | 473/294 |
| 6,817,956 | B1 * | 11/2004 | Dagenais | 473/300 |
| D504,928 | S | 5/2005 | Miller | |
| 6,890,265 | B2 | 5/2005 | Enlow | |
| 2003/0045369 | A1 | 3/2003 | Murray et al. | |
| 2005/0107181 | A1 * | 5/2005 | Shioda | 473/294 |

* cited by examiner

*Primary Examiner*—Stephen L. Blau
(74) *Attorney, Agent, or Firm*—Welsh & Flaxman LLC

(57) ABSTRACT

A golf club grip for attachment to a golf club shaft formed of an upper section having a first outer diameter, an intermediate tapered transitional area and a lower section having a second outer diameter larger than the upper section outer diameter. The upper section accommodates the ring finger and pinky finger of the upper hand. The intermediate tapered transitional section accommodates the middle and index fingers and the thumb of the upper hand. The lower section accommodates the fingers of the lower hand. The structure of the golf club grip promotes better feel and allows a golfer's non-dominant upper hand to obtain a firmer and stronger grip while allowing the dominant lower hand to impart more force to the ball with the golf club.

14 Claims, 2 Drawing Sheets

GOLF CLUB GRIP

CROSS REFERENCE TO RELATED APPLICATION

This application is a continuation-in-part of International Application No. PCT/US06/45694, filed Nov. 30, 2006, entitled "Golf Club Grip", which is currently pending; and this application is also a continuation-in-part of U.S. patent application Ser. No. 11/289,564, filed Nov. 30, 2005, entitled "Golf Club Grip", which is now abandoned.

BACKGROUND OF THE INVENTION

The present invention relates to golf club grips and, in particular, to a golf club grip with an improved configuration.

The game of golf is played using a golf ball and a variety of different golf clubs to strike the ball from a teeing area into a hole some distance away. Whereas the club heads vary widely, most golf clubs include a shaft attached to the club head and a grip or handle attached to the upper part of the shaft to enable a golfer to hold and swing the club.

Typically a golfer grips the golf club with both hands, normally in close proximity to each other at or near the upper end of the golf club shaft. Conventionally the golfer's weaker, or non-dominant, hand is placed in an upper position, whereas the stronger, or dominant, hand is placed just below the upper hand. It is well known that control of the golf swing by the lower, or dominant, hand produces poor golf shots whereas consistent, powerful and accurate golf shots are produced when the non-dominant hand and arm control the golf swing. In order to promote a better feel of the hands on the club, a right-handed golfer normally places his left hand near, or at the upper end of, the handle and places the right hand just below, usually with the little finger of the right hand overlapping or interlocking the index finger of the left hand. This creates a feel in both hands and allows the hands to work both independently and together when executing a golf swing without the dominant hand exercising too much control.

Most conventional golf club grips are formed with an outside diameter that gradually tapers from the uppermost, or butt, end of the golf club shaft toward the club head end of the shaft, becoming progressively thinner as the grip extends from the butt end of the grip to the club head. When playing the game of golf, it is customary for a golfer's leading hand (that is, the weaker, upper hand that is closest to the target) to be placed on the grip closest to the butt end of the club shaft. The trailing hand, which normally is the golfer's stronger or dominant hand, is placed below the leading hand on the portion of the grip that is more tapered, or thinner. In these relative positions, the weaker leading hand is required to hold and control the largest portion of the golf club grip, whereas the stronger trailing hand holds the smallest portion of the club grip. Therefore, the positioning of the weaker, upper hand on the largest part of the golf club grip contributes to the difficulty of a golfer maintaining a solid hold on the golf club while executing a golf shot.

The inventor has determined the larger diameter of the grip at the upper butt section creates an interaction between the large diameter end of the grip and the palm of the golfer's hand creating a tendency for a golfer to lift the club when the club is gripped thereby setting an angle between the club shaft and the golfer's arms. Slow motion pictures of a golfer's swing reveal this angle is virtually eliminated at impact. Therefore, it follows that the golfer must alter his or her swing path to eliminate the set-up angle exist at address between the shaft and arms. In other words, the golfer must change the swing path and/or the spine angle during the execution of the golf swing to eliminate the set-up angle resulting from the interaction between the palm of a golfer's hand and the larger diameter portion of the grip at the upper butt end of the grip.

These additional swing movements increase the difficulty of executing a repeating golf swing thus requiring endless practice and repetition of the golf swing to produce a consistent, repeatable golf swing.

Conversely, because of the smaller size along the lower portion of the golf grip, it is difficult for the stronger hand to impart sufficient force to the club head to impart maximum flight and trajectory to the golf ball during the execution of a golf shot. The smaller portion of the golf grip tends to cause premature release of the trailing, stronger hand resulting in a wide variety of errant golf shots.

A number of attempts have been made to provide golf grips with configurations to enhance gripping of the golf club. U.S. Design Pat. No. 504,928 to Miller shows a golf grip that is tapered upwardly toward the upper end of the golf club. U.S. Pat. No. 3,295,850 to Garrity shows a golf grip having a non-tapered lower gripping section for the trailing hand and a smaller diameter section for only the little finger of the leading hand. U.S. Pat. No. 6,817,956 to Dagenais discloses a putter type golf grip including a lower grip portion having a greater diameter than a separate, detached upper grip portion.

SUMMARY OF THE INVENTION

The present invention relates to a full swing golf club grip having three separately sized sections to enhance feel and control of the golf club during the execution of a golf shot. The grip structure includes an upper section closest to the upper end of the golf club having a first constant diameter sized to be engaged by the last two fingers of the weaker, upper hand. The grip structure includes a second tapered transitional section that is tapered with a gradually increasing outer diameter as it extends away from the upper section toward the lower section of the golf grip. This tapered transitional section creates a grasping area for the middle finger, index finger and thumb of the weaker, upper hand. The lower section interfaces with the end of the tapered transitional section and has a constant diameter greater than the diameter of the upper section.

All sections of the grip are manufactured in a manner forming a unitary golf club grip for both hands of the golfer holding the golf club. This grip configuration provides a separate feel to each hand as the club is gripped. The grip configuration, combined with the natural anatomy of the golfer's hand, allows the golf club to be held firmly without creating a shaft angle (that is, an angle between the golfer's leading arm and the shaft) at set-up (address). This is accomplished by the fingers of the upper hand each moving equal distances despite the overall difference in the anatomy of the fingers as the club is grasped tightly. This eliminates the fulcrum action of the fingers on the club grip relative to each other. That is, the design of the grip prevents the club head from rising off the ground as the grip is squeezed and creates an angle between the golfer's arms and club shaft. This occurs due to the configuration of the grip with a smaller diameter upper section, a tapered transitional section and a larger diameter lower section.

During the golf swing, the following benefits accrue to the golfer using the present grip. An erect set-up posture with less of a spine angle is more easily created. The golfer is better able to employ a one-plane swing; spine angle changes during the execution of the full swing are reduced or eliminated; and the tendency to rotate the body up and out of the swing is greatly reduced.

The upper section of the grip is designed to accommodate the pinky and ring finger of the golfer's upper hand. The intermediate tapered transitional section of the grip accommodates the middle and index fingers and the thumb of the upper hand. The lower section of the grip accommodates the golfer's lower hand.

The golf club grip of the present invention provides an increased feeling of control of the golf club by the non-dominant hand and a simultaneous decreased feel of control of the golf club by the dominant hand.

The golf club grip also provides increased gripping strength of the non-dominant hand with the smaller diameter of the grip. The grip also provides decreased gripping strength of the dominant hand by virtue of the physical difference in the gripping diameters afforded to each hand by the grip. The golf club grip also provides increased wrist-flex and release of the non-dominant hand actually and relatively to the dominant hand and decreased wrist flex and release of the dominant hand actually and relatively to the non-dominant hand during a full swing by virtue of physical difference in the gripping diameters of the grip.

In addition, the grip of the present invention affords increased resistance to unwanted discrete movements of the hands throughout the golf swing as compared to conventionally tapered golf grips.

All of the above features promote more control, confidence, power and accuracy in the golfer's swing than heretofore provided by any other golf club grip. The overall result is that a golfer is able to execute better golf shots that, in turn, promote confidence adding to the enjoyment of the game and resulting in better scores for the golfer.

Among the objects of the present invention is the provision of a golf club grip to provide a stronger grip by the weaker upper (or leading) hand during the execution of a golf shot.

Another object of the present invention is the provision of a golf club grip that prevents premature release of the stronger lower (or trailing) hand during a golf shot.

Still another object of the present invention is the provision of a golf club grip that provides a separate feel to each hand holding the golf club.

These and other objects of the invention will become apparent with reference to the following detailed description and drawings.

DESCRIPTION OF THE PREFERRED EMBODIMENT

Figure 1:
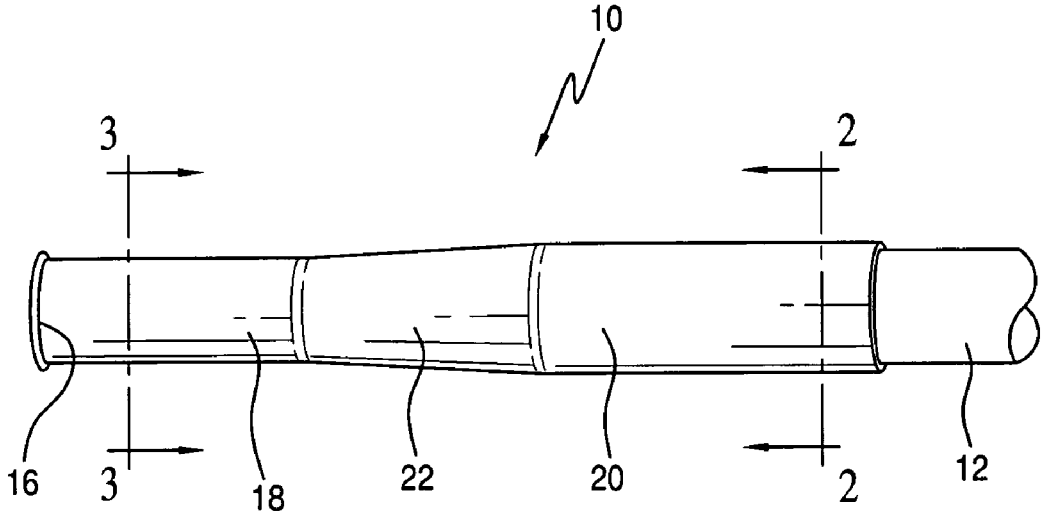
FIG. 1 is an elevational view of a golf club grip in accordance with the present invention.
Figure 2:
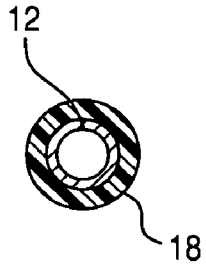
FIG. 2 is a sectional view taken along the lines 2-2 of FIG. 1.
Figure 3:
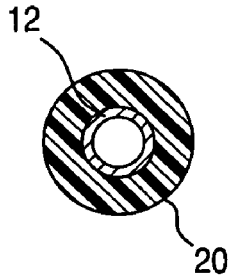
FIG. 3 is a sectional view taken along the lines 3-3 of FIG. 1.
Figure 4:
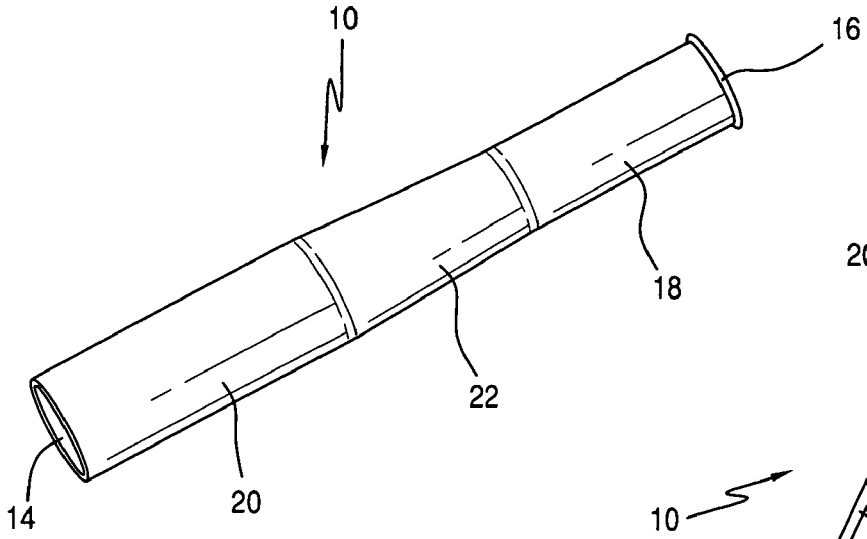
FIG. 4 is a perspective view of the golf club grip of FIG. 1.
Figure 5:
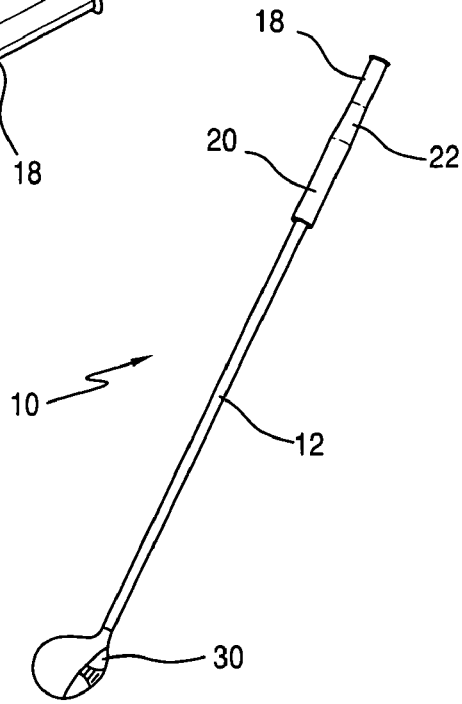
FIG. 5 is a perspective view showing the present inventive grip on a full swing club.

Referring to the drawings, a full swing golf club grip 10 in accordance with the present invention is shown positioned on a club shaft 12 with a club head 30 on the opposite end thereof. The grip 10 preferably is a molded, single, unitary unit and includes an opening 14 at the lower end of the grip 10 for insertion of a shaft 12 during assembly. A cap 16 is provided on the upper end of the grip 10 to cover the upper edges of the shaft 12. The grip 10 is formed of an upper section 18 having a first diameter, a tapered transitional area 22 having a gradually increasing diameter in a direction away from the upper section 18 and a lower section 20 formed with a second diameter greater than the diameter of the upper section 18. The tapered transitional section 22 connects the upper section 18 and lower section 20 whereby the entire grip 10 is formed of a single unitary piece of molded material. Both the upper section 18 and the lower section 20 have a constant, non-tapered, outer diameter and cross sectional area throughout the entire length of each section, and the tapered transitional section 22 smoothly tapers down in diameter from the larger diameter lower section 20 to the smaller diameter upper section 18.

In general, the upper section 18 is sized to accommodate the uppermost two fingers (that is, the pinky and ring finger of the weaker, upper hand) of the upper hand when the upper hand is properly positioned on the golf grip 10. The tapered transitional section 22 is sized to accommodate the other two fingers of the upper hand as well as the thumb of the upper hand that is placed on top of the grip 10 when the golf club is gripped normally. The lower section 20 of the grip 10 accommodates the fingers of the lower hand and is slightly less than approximately half the length of entire grip 10.

In accordance with a preferred embodiment of the present invention, the upper section 18 is approximately 2.5 inches in length, the tapered transitional section 22 is approximately 3 inches in length, or approximately 30% of the overall length of the grip 10, and the lower section 20 is approximately 4-5 inches in length.

In accordance with a preferred embodiment of the present invention, the outside diameter of the upper section 18 is between 0.590 inches and 1.102 inches and is preferably 0.827 inches in diameter along its entire 2.5-inch length. The lower section 20 has an outside diameter between 0.669 inches and 1.181 inches and is preferably 0.906 inches in diameter along its 4-5 inch length. The tapered transitional section 22 gradually increases in diameter from the upper section 18 to the lower section 20 of the grip 10 at a rate of 0.02 inches of diameter per inch of length to 0.03 inches of diameter per inch of length. Most preferably, the tapered transitional section increases in diameter from the upper section 18 to the lower section 20 at a rate of 0.0263 inches of diameter per inch of length. In accordance with a preferred embodiment where the upper section 18 has a diameter of 0.827 inches along a length of 2.5 inches and the lower section has a diameter of 0.906 inches along a length of 4 inches, the tapered transitional section 22 has a midpoint diameter of approximately 0.8665 inch along its 3-inch length. The transition angle or taper of the tapered transitional section 22 is constant and results in a linear outer grip surface between the upper section 18 and lower section 20.

It is contemplated that the transitional section ranges in length between approximately 2.5 and 3.5 inches, the upper section ranges in length between 2 to 3 inches and the length of the lower section is at least 4.0 inches.

It will be appreciated that the above dimensions are typical for golfers that have normal sized hands. These dimensions may be made smaller or larger to accommodate golfers with different size hands as long as the relative sizes between the various sections are maintained.

The utilization of an upper section 18 with a tapered transitional section 22 extending to a lower section 20 as described above allows the upper and lower hands of a user to more comfortably grip the golf club in a manner optimizing the ability of the golfer to both address the ball and impact the ball without altering the swing path to eliminate the set-up angle between the shaft 12 and arms of the golfer. In other words, because of the present grip 10 the set-up angle between the shaft 12 and the arms of the golfer is reduced and the golfer need not change the swing path and/or the spine angle during the execution of the golf swing to eliminate the set-up angle resulting from the interaction between the palm of a golfer's hand and the larger diameter portion of the grip 10 at the upper butt section of the grip 10.

In particular, the tapered transitional section 22 acts upon the forefinger such that there is not a bias to create a set-up angle described above. With this in mind, the length of the tapered transitional section 22 is critical in that it should be sufficient to allow a surface area upon which the forefinger may lie while not being so long that the entire upper hand or a substantial portion of the lower hand sits thereon during the club swing. In addition, and as discussed above, the upper section 18 includes a constant diameter. The constant diameter, when considered in view of the adjacent tapered transitional section 22, allows the golfer to apply consistent pressure to the golf grip 10 upon gripping by both the pinky and the ring finger (while the forefinger sits upon the tapered transitional section 22) in a manner optimizing the angular orientation of the hand relative to the shaft 12. With these factors in mind, the present grip 10 provides a comfortable surface upon which an individual may grip the club head in a manner such that alterations in body stance are unnecessary to compensate for the ergonomic interaction between the grip 10 and the hands of a golfer.

When using the full swing golf grip 10 of the present invention, it is contemplated that a normal grip position of the golfer's hands is used to hold the golf club. For example, a right-handed golfer places the pinky and ring finger of the non-dominant left hand on the upper section 18 of the grip 10. The middle and index fingers are placed on the tapered transitional section 22 and the dominant right hand is placed on the lower section 20 of the grip 10. The fingers may be interlocked or overlapped or otherwise kept together. During the execution of a full golf swing, the non-dominant upper hand will hold the smaller upper section 18 and the tapered transitional section 22 of the grip 10 proportionally tighter and/or with greater force because of the smaller size. The larger, lower section 20 allows a golfer to impart a greater impact force with his dominant lower hand to the golf ball without premature release. This results in greater stabilization of the club head and more consistent and longer golf shots with an increased feel as the club is swung.

The essence of the invention is the use of separate but connected sections 18, 20 of a golf grip 10 having two different diameters and a smooth tapered transitional section 22 connecting them. The sections are formed to accommodate the two hands of the golfer, the upper (or smaller) section 18 and the tapered transitional section 22 for the non-dominant hand and the lower (or larger) section 20 for the dominant hand. Therefore, it will be appreciated that the relative size and/or ratio of the two diameters may vary depending upon the size of the hands of the golfer. It will also be appreciated that although the preferred embodiment of the grip uses constant diameters for both the upper and lower sections 18, 20 of the grip 10, one or both of the sections may have a very slight taper adjacent an upper or lower end thereof. This slight taper would be in a section of a quarter inch or less.

Golfers move their shoulders away from the ball during their downswing as they stand up more erect than when initially addressing the ball and thus decrease their spine angle. Spine angle being how many degrees one tilts their upper body forward from vertical at address. For most golfers, their spine angle is 25-30 degrees at address when using a driver and 10-15 degrees upon impact. The grip 10 of the present invention, when used properly, functions to minimize the change of a golfer's spine angle between address and impact.

Figure 6:
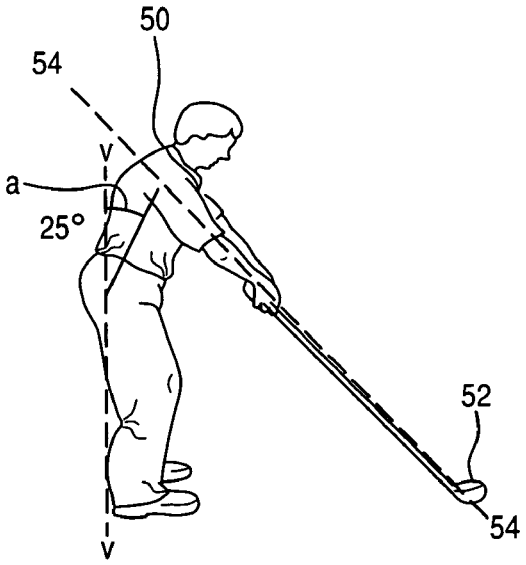
FIG. 6 is a diagram showing desired spine angle at set-up or address with the golfer's arms and club shaft lying in a single plane.
Figure 7:
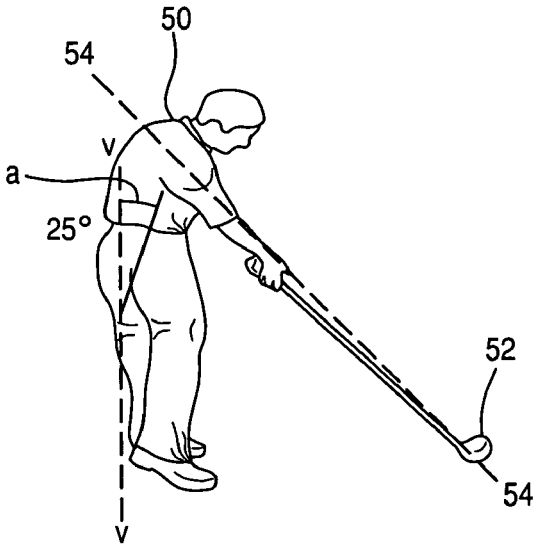
FIG. 7 is a diagram showing desired spine angle at impact with the golfer's arms and club shaft still lying in a single plane.

As seen in FIGS. 6 and 7, the present grip allows a golfer 50 to grip the full swing club 52 and maintain his arms and club shaft 12 in a single plane 54 while having a spine angle (a) between 25-30 degrees from the vertical line (v) at address as shown in FIG. 6 and maintain the same spine angle at impact as shown in FIG. 7.

The reason behind the ability to maintain the same spine angle at address and at impact is the reverse taper transitional section 22 combined with the constant diameter upper section 18. When a golfer grips the club with their index finger of the upper non-dominant hand in the tapered transitional section 22 their upper two fingers (i.e., pinky and ring finger) grip the club in the constant diameter smaller upper section 18.

The present inventive grip 10 makes it comfortable or more natural to grip the full swing club such that the arms lie in the same plane as the club shaft 12. This is due to the ergonomics of the hand. Thus when the ball is addressed and then struck at impact a golfer is not forced to stand more erect in order to be comfortable.

Other modifications or changes may be made to the grip of the present invention without departing from the spirit and scope of the invention as defined in the following claims.

The invention claimed is:

1. A golf club grip for attachment to a full swing golf club shaft wherein the improvement comprises:

a lower section of said grip having a first outer diameter and an upper section of said grip having a second outer diameter smaller than said first diameter;

a transitional section connecting said lower and upper sections; said transitional section having an outside diameter progressively tapering between said upper and lower sections;

said upper section characterized by having a size providing sufficient gripping space to accommodate the upper two fingers of the upper hand of a golfer; said transitional section characterized by having a size providing sufficient gripping space to accommodate the lower two fingers and thumb of the upper hand; and, said lower section characterized by having a size providing sufficient gripping space to accommodate all of the fingers of the lower hand;

said first and second outer diameters being constant along the entire length of each section;

said grip being formed as a single, unitary unit; and wherein said transitional section connecting said lower and upper sections being further defined wherein the change in outer diameter from one end to the other end of the transitional section is at a rate ranging between 0.02 to 0.03 inch per diameter per inch of length.

2. A golf club grip for attachment to a full swing golf club shaft of claim 1, wherein the change of diameter is 0.0263 inch per diameter per inch of length.

3. A golf club grip for attachment to a full swing golf club shaft of claim 2, wherein the transitional section ranges in length between approximately 2.5 and 3.5 inches.

4. A golf club grip for attachment to a full swing golf club shaft of claim 3, wherein the length of the upper section is approximately 2.5 inches and the length of the lower section is at least 4.0 inches.

5. A golf club grip for attachment to a full swing golf club shaft of claim 1, wherein the outer diameter of the upper section of said full swing grip ranges between approximately 0.590 to 1.102 inches.

6. A golf club grip for attachment to a full swing golf club shaft of claim 1, wherein the outer diameter of the upper section of said full swing grip is approximately 0.827 inches.

7. A golf club grip for attachment to a full swing golf club shaft of claim 1, wherein the outer diameter of the lower section of said full swing grip ranges between 0.669 and 1.181 inches.

8. A golf club grip for attachment to a full swing golf club shaft of claim 1, wherein the outer diameter of the lower section of said full swing grip is 0.906 inches.

9. A golf club grip for attachment to a full swing golf club shaft of claim 1, wherein the length of the transitional section is approximately 30% of the overall length of the grip.

10. A full swing golf club with grip wherein the grip comprising: a lower grip section having a first constant outer diameter between 0.669 and 1.181 inches; an upper grip section having a second constant outer diameter between 0.590 and 1.102 inches; and; a tapered transitional section connecting said lower and upper grip sections is 3 inches in length and wherein the change in diameter from one end to the other end of the transitional section is 0.079 inch.

11. The full swing golf club of claim 10, wherein the length of the transitional section is approximately 30% of the overall length of the grip.

12. The full swing golf club of claim 10, wherein the transitional section ranges in length between approximately 2.5 and 3.5 inches.

13. The full swing golf club of claim 12, wherein the length of the upper section is approximately 2.5 inches and the length of the lower section is at least 4.0 inches.

14. The full swing golf club of claim 10 wherein said transitional section connecting said lower and upper sections being further defined wherein the change in outer diameter from one end to the other end of the transitional section is at a rate ranging between 0.02 to 0.03 inch per diameter per inch of length.

* * * * *